United States Patent [19]

Mucha et al.

[11] Patent Number: 4,816,633

[45] Date of Patent: Mar. 28, 1989

[54] METHOD OF MONITORING INDUCTION HEATING CYCLE

[75] Inventors: George M. Mucha, Parma Heights, Ohio; Jonathan W. Alexander, Boaz, Ala.; George D. Pfaffmann, Farmington, Mich.; Richard H. McKelvey, Albertville, Ala.

[73] Assignee: Tocco, Inc., Boaz, Ala.

[21] Appl. No.: 138,561

[22] Filed: Dec. 28, 1987

Related U.S. Application Data

[62] Division of Ser. No. 22,868, Mar. 6, 1987.

[51] Int. Cl.[4] ..... H05B 6/06

[52] U.S. Cl. ..... 219/10.41; 219/10.77; 219/10.51; 266/80

[58] Field of Search ..... 219/10.77, 10.75, 10.41, 219/110, 497, 506, 10.57; 266/80, 96; 364/477, 472

[56] References Cited

U.S. PATENT DOCUMENTS

| | | | |
|---|---|---|---|
| 3,743,808 | 0/1973 | Kasper | 219/10.41 |
| 3,888,405 | 0/1975 | Jones et al. | 228/2 |
| 4,059,795 | 11/1977 | Murdwinkin | 324/233 |
| 4,230,987 | 10/1980 | Mordwinkin | 324/236 |
| 4,317,980 | 0/1982 | Goodrich et al. | 219/117.1 |
| 4,427,463 | 1/1984 | Spies | 266/90 |
| 4,570,230 | 0/1986 | Wilson et al. | 364/477 |
| 4,618,125 | 10/1986 | Balzer | 219/10.57 X |
| 4,651,283 | 0/1987 | Sciaky et al. | 364/477 |
| 4,683,361 | 0/1987 | Driggers | 219/10.43 |

OTHER PUBLICATIONS

Mordwinkin, et al., "New Induction Qc Method Uses Eddy Current Principle", Heat Treating, Nov. 1986.

*Primary Examiner*—Philip H. Leung

*Attorney, Agent, or Firm*—Body, Vickers & Daniels

[57] ABSTRACT

A method of monitoring a heating cycle of an induction heating system wherein an inductor encircles a metal workpiece and an alternating current is applied through the inductor from a power supply during the heating cycle. This method comprising the steps of generating an analog signal representative of the voltage across said inductor, as the voltage varies during said heating cycle by changes in the electromagnetic characteristics of the workpiece as the workpiece is being heated; digitizing the voltage representative analog signal; creating a trace of the digitized voltage representative analog signal, with the trace being indicative of the electromagnetic characteristic of the workpiece as sensed by the inductor voltage during the heating cycle; and, comparing the created trace with a preselected pattern. This method can be performed with the workpiece moving through the inductor during said heating cycle and when the heating cycle includes a number of sub-cycles when the power supply is energizing the inductor separated by periods when the power supply is not energizing the inductor.

3 Claims, 4 Drawing Sheets

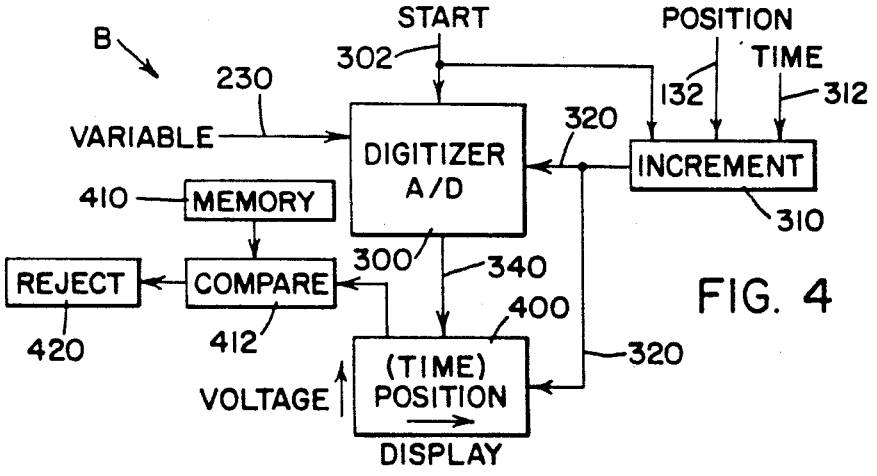
FIG. 4
FIG. 5
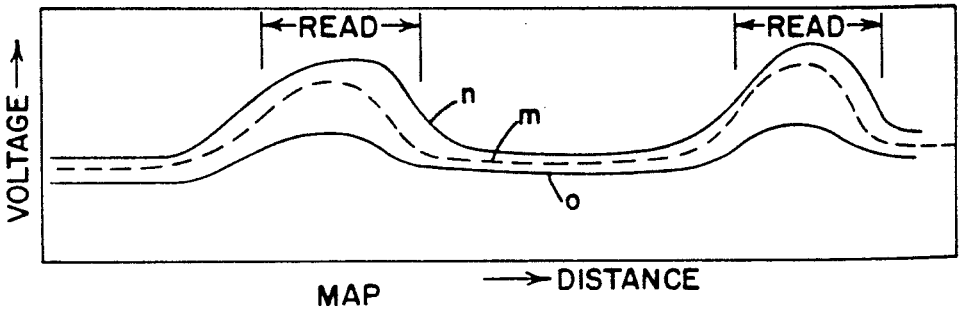
FIG. 6
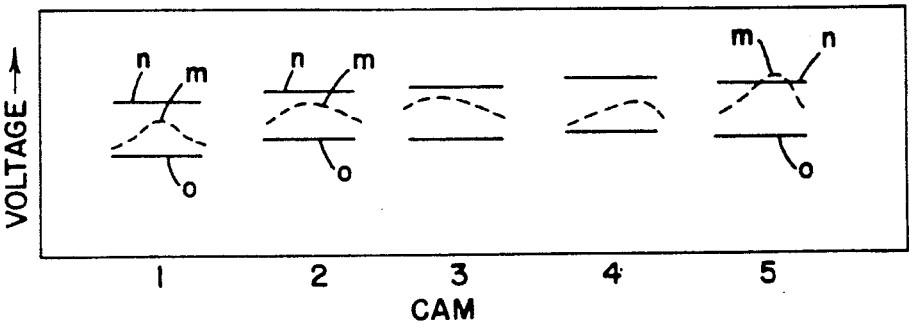

METHOD OF MONITORING INDUCTION HEATING CYCLE

This is a division of application Ser. No. 022,868, filed Mar. 6, 1987.

The present invention relates to the art of induction heating and more particularly to a novel method of monitoring the actual heating cycle of an induction heating system as the cycle is being performed.

INCORPORATION BY REFERENCE

The present invention relates to the concept of monitoring the actual heating cycle of an induction heating system as the cycle is being performed; however, the signal obtained in accordance with the invention relates to the reflected electromechanical characteristics of the workpiece, as such characteristics change during heating. This complex phenomenon with voltage and current has been found to generally correspond to the reflected electromechanical characteristics monitored by an eddy current detector as used to analyze a static metal workpiece. Such eddy current analyzers have been known for some time even though they have not been widely used due to general lack of industrial interest in such static metal analyzers.

Two of several concepts or equipment employed for eddy current analysis are illustrated in Mordwinkin U.S. Pat. Nos. 4,059,795 and 4,230,987. Due to the similarity in the signal created in accordance with the present invention and the reflected signal used in such eddy current analyzers, the circuitry and equipment employed in these two references is incorporated by reference, as the present preferred embodiments for performing the inventive method of the present disclosure. Also incorporated by reference herein is an article from Heat Treating November 1986, pages 34–38 entitled "New Induction QC Method Using Eddy Current Principle" by George Mordwinkin, Authur L. Vaughan and Peter Hassell. This recent article reports on the manner in which the present invention can be practiced by utilizing the circuitry illustrated in U.S. Pat. No. 4,230,987. The use of eddy current analysis during a cooling cycle is generally explained in Spies U.S. Pat. No. 4,427,463. This patent is also incorporated herein as background information.

The concept of scanning a camshaft by an eddy current detector device is disclosed and claimed in Balzer U.S. Pat. No. 4,618,125 and is further disclosed and claimed in a particular heating operation in patent application Ser. No. 859,348, filed May 5, 1986 by assignee of the present application. This prior patent and this copending patent application are incorporated by reference herein as containing further information regarding the use of eddy current type sensors and analyzers for determining the posthardening characteristics of inductively heated and then quench hardened sections of an elongated workpiece.

Prior application Ser. No. 834,570 filed Feb. 28, 1986 and owned by the assignee of the present application illustrates a system for employing an eddy current detector for monitoring and controlling the cooling cycle of a previously inductively heated workpiece. This prior application, together with the Balzer patent and patent application Ser. No. 859,348, are incorporated by reference for the further purpose of illustrating the state of the art of non-destructive testing by eddy current technology of inductively heated metal workpieces.

These concepts were being developed by the common assignee concurrently with the development of the present invention involving a method of non-destructive testing during the heating cycle itself. Principles of eddy current technology are used only to the extent that the signals created by the present invention can be processed by some known eddy current analyzer equipment.

BACKGROUND OF INVENTION

The present invention is particularly applicable for monitoring the actual heating characteristics of an induction heating system as the system is heating a metal workpiece while it is stationary and it will be described with particular reference thereto; however, as discussed in this application, the invention has broader applications and may be employed for monitoring the actual heating cycle of successive heating cycles employing an induction heating coil encircling a metal workpiece which is stationary or axially movable through the inductor.

For many years the induction heating industry has been considering the possibility of controlling induction heating systems by a variety of non-destructive sensors which could be interfaced with appropriate microprocessors or programmable controllers to either control the actual processing of a workpiece or determine when such workpiece was defective. Such "smart" control systems for induction heating equipment have been primarily incorporation of pyrometers, heat sensors and watt meters to control the power applied to the workpiece during processing. This type of integrated control has been primarily applicable for induction heating of long wires or strands. It was not applied to production processing of discrete workpieces and inductively heated for quench hardening in the automotive industry, or other consumer product industries. To control discrete workpiece heating in mass production induction heating systems, there has been really few successful control mechanisms for in-process monitoring. As disclosed in Balzer U.S. Pat. No. 4,618,125, it is possible to pass a previously induction heated quench hardened camshaft through or with respect to an eddy current sensing device to determine whether or not the hardening operation is in accordance with a preselected plan or pattern. The adaptation of eddy current principles and technology to evaluating the quality of a previously processed part or workpiece, including one or more selectively hardened portions, was pioneered by assignee of the present application and is disclosed in the prior patent together with the previously mentioned copending patent application on processing hardened camshafts. As is well known, the eddy current sensing arrangement, as disclosed in the Balzer patent, can only detect the history of an inductively heated and quench hardened workpiece, whether heating is done with the workpiece stationary or movable, such as a camshaft hardening process.

When developing the concept of moving an eddy current detector coil around a previously hardened workpiece having axially spaced differences in hardness and metallurgical characteristics, a variety of systems could be employed to pulse an eddy current driving coil and to evaluate the reflected pulses from the eddy current pick-up or sensing coil. One of such systems is illustrated in FIGS. 12 and 13 of copending application Ser. No. 859,348, filed May 5, 1986. Another system which could be used to drive the eddy current coil and detect the electromagnetic characteristics of the workpiece along its length by an encircling eddy current detection coil is illustrated in Mordwinkin U.S. Pat. Nos. 4,059,795 and 4,230,987. These two patents, which are incorporated by reference herein, are directed to the use of eddy current technology to determine metallurgical characteristics of a stationary metal specimen primarily for the purpose of determining the identity of the specimen, much like spectrum analysis. This eddy current processing circuit and concepts illustrated in the Mordwinkin patents can be employed for the purpose of sensing the electromagnetic characteristics along the length of a previously hardened camshaft, as illustrated in Balzer U.S. Pat. No. 4,618,125. Indeed other eddy current driving and sensing circuits can be employed for detecting the electromagnetic characteristics of a workpiece movable through a pair of coils after the workpiece has been inductively heated and then quench hardened in a manner similar to a camshaft. Such detection will involve both physical characteristics of the workpiece, such as geometry which cannot change during hardening, and metallurgical characteristics such as hardness, grain size, grain phase, etc.

When such eddy current technology is applied to in-process use, in conjunction with induction heating, it has been found by assignee to be quite beneficial and has been, or is, in the process of being widely accepted by industry, especially the automotive and consumer product industries. By these non-destructive testing procedures previously hardened portions of a complex workpiece can be analyzed to determine whether or not the workpieces conform to a preselected pattern and/or characteristics ascribed to acceptable workpieces; however, like many advances in the induction heating art, this advance in non-destructive testing to monitor the actual performance of a complex induction heating process or system has several disadvantages. A special driving coil and sensing coil must be employed. A special work station must be provided when space for such a station is usually at a premium. The eddy current testing system requires additional processing time, since the eddy current testing of the previously hardened portions, even when done by scanning, requires cycle time. Eddy current equipment also requires a power source for energizing the driving coil, which power source adds further cost, expense and maintenance difficulties to the total induction heating system or equipment.

In view of this state of the art, assignee of the present application has been seeking an arrangement for in-process monitoring of induction heating equipment, without requiring destructive testing and without the disadvantages concomitant with prior efforts, albet somewhat successful, to apply eddy current technology to the induction heating field.

THE PRESENT INVENTION

The present invention relates to a method of monitoring the actual heating cycle in a fashion similar to eddy current testing without the disadvantages of previous attempts to employ eddy current testing in the induction heating industry, as illustrated in the prior Balzer patent and pending applications owned by the assignee of the present application.

In accordance with the present invention, there is provided a method of monitoring the heating cycle of an induction heating system of the type wherein an inductor encircles, either completely or partially, a metal workpiece and an alternating current is applied through the inductor from a power supply during the heating cycle. The workpiece within the inductor is inductively heated for tempering, subsequent quench hardening, etc. An analog signal, representative of the voltage across the inductor, or similar in-process variable, is generated while the inductor voltage varies during the heating cycle by changes in the electromagnetic characteristics of the workpiece as the workpiece is actually being heated. This analog signal is obtainable by sensing the instantaneous voltage across the inductor or the voltage from the power supply. Instantaneous in this context means that there is a continuous monitoring of the voltage across the inductor to create an analog signal representation of the actual voltage. Such instantaneous reading can be obtained by a potential transformer. The fact that this analog signal varies according to the electromagnetic characteristics of the workpiece, be they position, geometry, mass concentrations, temperature resistivity, or properties of the metal and its changing conditions during the heating cycle, is used in the present invention. The term "heating cycle" anticipates either heating a workpiece that is stationary or a workpiece that is moved intermittently or continuously through the induction heating coil or inductor during the heating cycle. The total heating cycle can be formed from several heating subcycles such as employed when processing the axially spaced cams on an automotive camshaft, as shown in Balzer U.S. Pat. No. 4,618,125. The "heating cycle" means the actual processing during which power is applied to the inductor for the purpose of inductively heating a discrete workpiece, even though the cycle can include certain periods when the inductor is not energized.

In accordance with the method of the present application, this created analog signal includes complex intelligence regarding the actual heating of the workpiece during the heating cycle and is subsequently digitized to produce digital information indicative of voltage magnitude at preselected times during the heating cycle. Of course, if the inductor is not energized the magnitude is a steady state and would be so indicated in the digitized information being collected with respect to the analog characteristics of the voltage applied during the heating cycle. This digitized voltage representative analog signal is then employed for creating a trace or signature which is indicative of the magnetic characteristics of the workpiece as sensed by the inductor voltage during the heating cycle. This trace or signature is compared with a preselected pattern, limit, or constructed trace to determine whether or not the heating cycle, being preformed, is in accordance with the desired heating cycle of the particular discrete part or workpiece being processed. Of course, if the heating cycle requires substantial sequential operations, such as a camshaft hardening system, as soon as the continuous trace being created indicates deviation from a preselected level, the system can be interrupted for the purpose of immediate attention by an operator. In the alternative, completed trace or signature can be created and compared with the preselected total trace to determine whether a part or workpiece itself is defective or within quality control standards. Either one of these processes can be employed by using the present invention which allows monitoring of the actual heating process in an induction heating system, a concept which heretofore has eluded the induction heating industry.

It has been determined that the electromagnetic characteristics of a workpiece being heated within an induction heating coil cause variations in the voltage across the coil by changing the reflected impedance or effective reflected impedance as the characteristics of the heated portion of the workpiece vary. These characteristics, as reflected into the coil or inductor during the heating cycle while the inductor is energized, have been found to present a relatively accurate indicia of the induction heating process as it progresses to inductively heat the workpiece or a selected portion thereof. After a proper heating cycle has been performed for a known, discrete workpiece, no matter how complex, traces generated during proper heat cycles can be reproduced and/or stored. After processing several workpieces, they can be tested destructively or by other techniques to determine whether or not they are acceptable. The correlation between acceptable workpieces and the trace or signature created by using the present invention can then be employed as the preselected pattern for mass production use of the present invention with the same type of discrete workpieces. During production use, continuous monitoring of the voltage across the inductor during the heating cycle, whether made up of several spaced cycles or not, can be continuously compared with the preselected pattern or can be compared with this pattern at the conclusion of the completed heating cycle. Continuous comparison or subsequent comparison between the ongoing heating cycle and a preselected pattern, trace, limit or signature are both concepts within the anticipation of the present invention. Of course, the preselected pattern or signature has accepted tolerances, which may vary from position-to-position, from time-to-time or from one portion of an ongoing heating cycle to another portion of an ongoing heating cycle.

In accordance with the invention, the analog or digitized voltage representative signal is sampled and recorded in a fashion synchronized with a series of synchronizing signals, which signals can be spaced according to time or can be based upon the actual physical position of the workpiece as it moves through the induction heating inductor. Of course, combinations thereof could be employed for determining the trace or signature of a given workpiece, which is to be subsequently compared with the preselected pattern, trace or signature to determine the acceptability and optimization of the heating cycle itself.

The primary object of the present invention is the provision of a method of monitoring a heating cycle of an induction heating system to obtain a trace or numerical representation of the actual heating operation.

Still a further object of the present invention is the provision of a method, as defined above, which method requires a minimum of capital equipment, virtually no increased cycle time and can be easily integrated into existing and state of the art induction heating systems.

Yet another object of the present invention is the provision of a method of monitoring the heating cycle, as defined above, which method produces a trace or signature useful in determining the acceptability of an induction heated part or workpiece. The trace or numerical representation obtained by the present invention can be employed as a substitute or alternative to standard eddy current technology applied to induction heating as suggested by Balzer U.S. Pat. No. 4,618,126. Indeed, this object of the invention is to develop a signal adapted to be processed by standard eddy current equipment without the need for driving and sensing equipment.

Still a further object of the present invention is the provision of a method, as defined above, which method produces a desired signature or trace which is indicative of the actual heating cycle performed on a workpiece, whether or not the workpiece is stationary, axially movable or otherwise associated with the heating inductor of the induction heating equipment or system.

Still a further object is the provision of a method, as defined above, which method produces a trace generally similar to and somewhat correlated with a trace obtained by scanning an eddy current driving and sensing coil along a workpiece previously processed in accordance with standard induction heating technology.

These and other objects and advantages will become apparent from the following description taken together with the accompanying drawings in which:

BRIEF DESCRIPTION OF DRAWINGS

FIG. 4 is a block diagram illustrating the present invention as used with the system schematically illustrated in FIG. 3;

FIGS. 5 and 6 are traces and partial traces obtainable from using the present invention in the induction heating system schematically illustrated in FIG. 3;

PREFERRED EMBODIMENT

Figure 1:
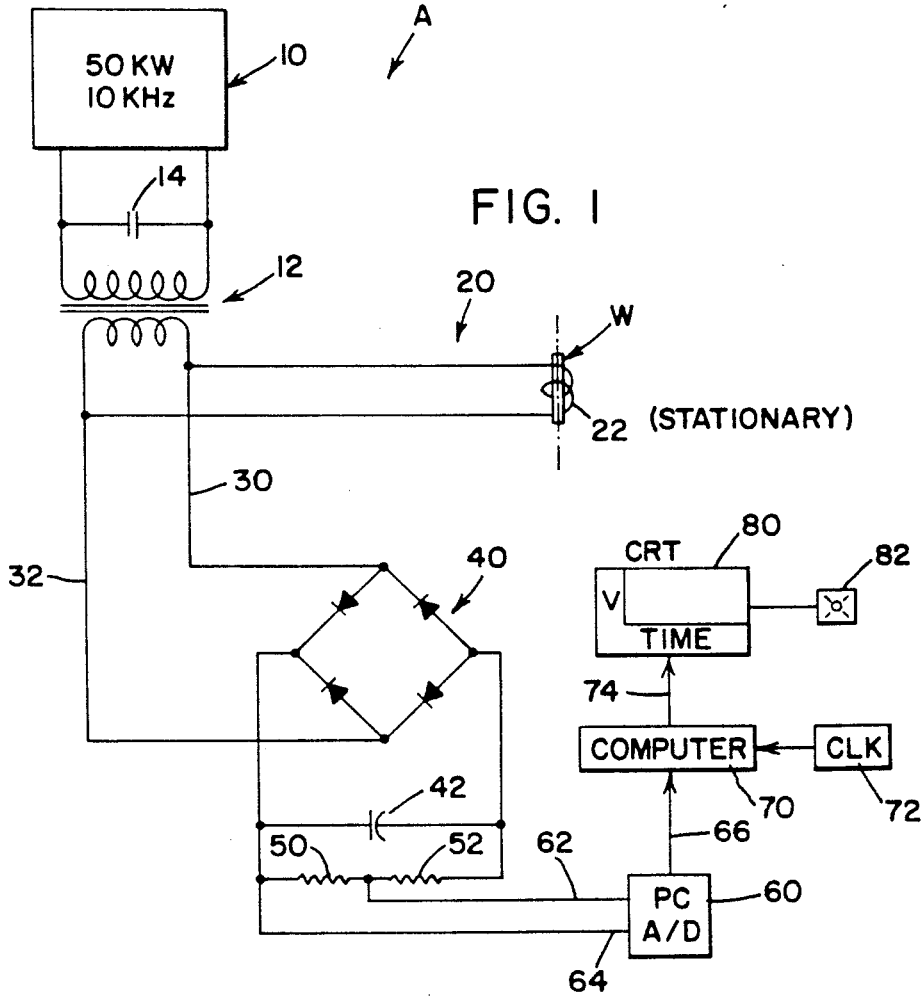
FIG. 1 is a schematic layout of the preferred embodiment of the present invention.

Referring now to the drawings wherein the showings are for the purpose of illustrating a preferred embodiment of the invention only and not for the purpose of limiting same, FIGURE 1 shows an induction heating system A of the type to which the present invention is particularly adapted. This system is schematically illustrated as having a solid state inverter 10, represented as a current source inverter, having a nominal output of 50 KW at 10 KHz and used to drive a step down transformer 12 having a power factor correcting capacitor or capacitor bank 14. The output load 20 for the inverter is an inductor 22 having, in most instances, only a few turns such as, in the preferred embodiment, a single turn. The turns are generally less than about ten. This inductor is substantially different and distinct from eddy current driving and sensing coils which have several hundred turns to create a substantial magnetic field with a low current flow.

Figure 2:
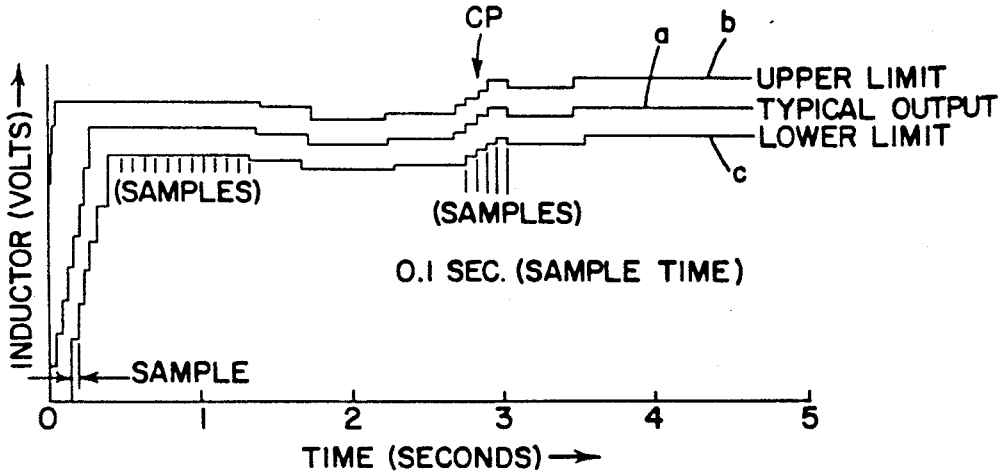
FIG. 2 is a graph illustrating the trace, profile or signature of a stationary workpiece heated by induction heating coil processed in accordance with the preferred embodiment schematically illustrated in FIG. 1.

A stationary workpiece W is surrounded by inductor 22. Alternating current through inductor 22 during the heating cycle causes current flow within worpiece W to raise the temperature of the workpiece in accordance with standard induction heating technology. As so far described, system A is a standard induction heating installation. Of course, mechanical power supplies and oscillators are often used for induction heating, consequently, the present invention can be employed for various power supplies with only minor modifications, which modifications will be apparent from the explanation of the invention. To practice the present invention, an analog signal representative of the voltage across inductor 22 is created while the workpiece W is being heated during a heating cycle. To obtain, or create, this analog signal representative of the voltage, leads 30, 32 connect a rectifier 40 in parallel with inductor 22. The output of the rectifier is smoothed through a filter 42 and is applied across the resistor 50 which, together with resistor 52, produces a step down of the voltage. This lower analog signal which is still representative of the instantaneous voltage across inductor 22 is about 5.0 volts and is applied to a programmable controller 60 through I/O terminals 62, 64. Programmable controller 60 converts the analog signal to a digital signal thereby digitizing the voltage across terminals 62, 64 on a generally continuous basis. The digital representation of the voltage level across the inductor 22 existing as the heating cycle is performed is outputted from programmable controller through I/O terminal 66, only one line of which is illustrated. Consequently, output terminals from the programmable controller contain the instantaneous digital representation of the voltage across inductor 22 even though it can be offset from real time. This package of information is inputted to a standard IBM PC computer 70 having an internal or external clock 72 which clock, in practice, is set for the digitized level or value at terminal 66. Output 74 of computer 70 is connected to CRT 80 for displaying the digitized representations of voltage across inductor 22 on the screen of the CRT. In practice, the ordinate is voltage level and the abscissa is time from 0 to 5 seconds with 0.1 second samples as shown in FIG. 2. If the heating cycle is less than 5 seconds, the digitized information would still be applied to the CRT or display 80 and the voltage level would drop to zero or a low level before reaching the end of the graph. An alarm 82 can signal an unacceptable workpiece heating cycle.

Referring now in more detail to FIG. 2, the graph on display 80 is illustrated graphically. This graph is in the form of a trace a which is formed by the digitized voltage representative analog signal and is indicative of the voltage across inductor 22 at each of the sample times, in this illustration each 0.1 second increment. Trace a is indicative of the electromagnetic characteristic of the workpiece, as sensed by the inductor voltage during the actual heating cycle of workpiece W. To determine whether or not the recorded heating cycle is in accordance with desired limits, two traces b, c are created on the display to define acceptable tolerances. Consequently, during each heating cycle of a separate workpiece W the existing trace a is compared to the preselected traces b, c. Should the curved trace a, during a heating cycle, exceed the limits in traces c, b, the heating cycle would be identified as unacceptable and an appropriate alarm or indicator is actuated. This action triggers at the time of deviation from the limits or later from a comparison of a new trace with the limit after the heating cycle has been completed.

The graphs in FIG. 2 were obtained by using Westinghouse PC 1100 programmable controller for analog-to-digital conversion. This digital output was directed to an IBM personal computer with a display of voltage on the vertical axis, or ordinate, and time on the horizontal axis, or abscissa. The computer was also programmed to display the upper and lower limits so that intersection of either of these limits, curves or traces by the new trace would produce an output from the computer. The upper and lower traces b, c shown in FIG. 2 could be patterns obtained during heating at different locations along a workpiece within the heating coil. In this manner, the trace a could be used to determine that the workpiece was not or is not being heated in accordance with acceptable parameters. A part can be rejected because of improper metal, improper heating, improper position, improper part or a defect in the part. The Currie Point reached during the heating cycle is marked CP.

Figure 3:
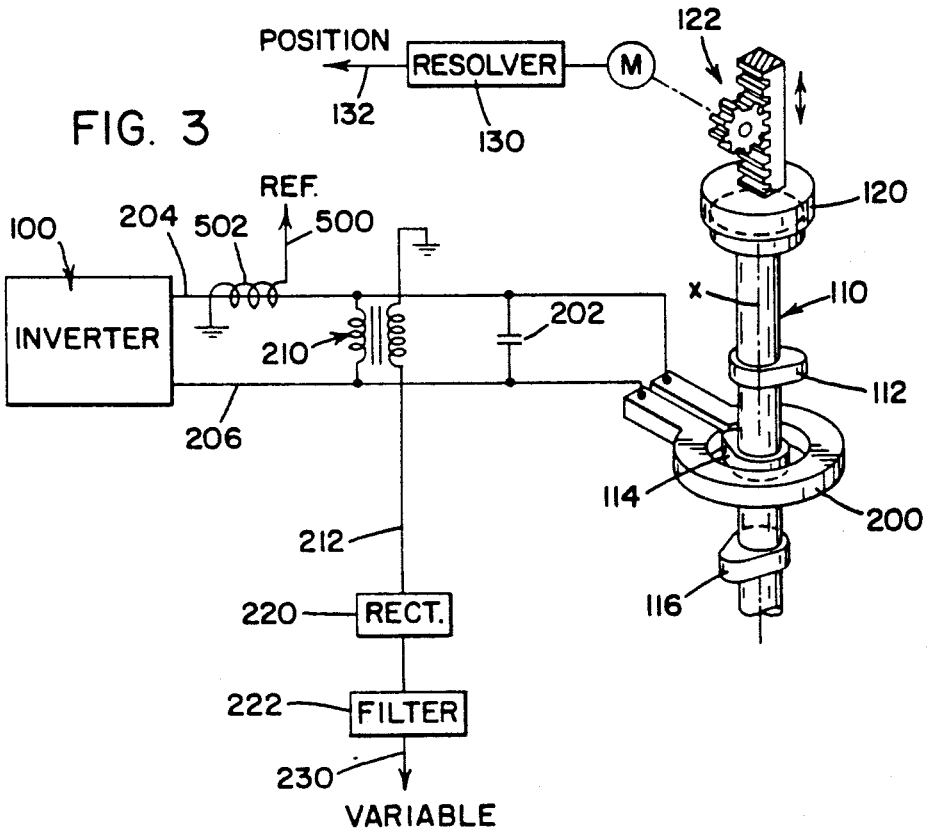
FIG. 3 is a schematic layout of an induction heating system employed for inductively heating the axially spaced cams of a camshaft, a heating supply to which the present invention is especially applicable.

Referring now to FIG. 3, inverter 100 is the same as inverter 10 in FIG. 1 and is employed for the purpose of inductively heating cams 112, 114, 116, etc., of camshaft 110 for the purposes of successively quench hardening these cams in accordance with standard induction heating practice. Camshaft 110 is mounted to rotate about axis x and is held by a chuck 120 which can rotate the camshaft as it is heated inductively at each cam surface. Of course, the camshaft can be heated inductively at each cam surface while the camshaft 110 is stationary. To index the camshaft from cam-to-cam, a schematically illustrated indexing mechanism is shown as a rack and pinion 122 driven by motor M having a resolver 130 so that the axial position of the camshaft can be indicated by pulses or other synchronizing signals from the POSITION output 132. In accordance with standard practice, inductor 200 encircles axis x and has a central opening sufficiently large to allow passage of cam surfaces 112, 114, 116, etc., as shaft 110 is indexed axially to bring, successively, each of the cam surfaces, respectively, into inductor 200 for induction heating preparatory to quench hardening by a quench unit just below the inductor, which quench unit is not shown. In accordance with standard practice, power factor correcting capacitor 202 is connected across the output of leads 204, 206 of inverter 100. To determine the instantaneous voltage across inductor 200, a potential transformer 210 is used. The secondary of this transformer produces an analog voltage signal in line 212. This signal is representative of the voltage across inductor 200 and varies according to the changes in electromagnetic characteristics of the cam surface being heated by alternating current from solid state inverter 100. The analog signal output 212 can be rectified by rectifier 220 and smoothed by filter 222 to produce a variable analog signal in line 230 which signal is representative of the electromagnetic characteristics of the heating cycle, as captured by variations in the voltage across inductor 200.

It has been found in one test that the peak voltage across an inductor varied between 20.09 volts and 21.12 volts in a 15 KW heating cycle with a 0.06 coupling on a cylindrical workpiece held stationary for a heating cycle of about 5.0 seconds. Distinct changes occurred by differences in laminations, differences in coupling and related changes. Thus, the peak voltage fluctuated between 5–10% by variations in geometric and physical features of the workpiece. The same magnitude of changes has been experienced in normal heating operations for discrete workpieces. Traces a of FIG. 2 do not vary drastically and the scale should be magnified in the vertical direction for a calibration in overall magnitude. For that reason, sensitive equipment to determine variations in the voltage for reducing noise are used in practicing the method of the present invention. This is done by removing the rectifier which improves the sensitivity and repeatability of the results obtained by practicing the present invention. In this manner, the RMS is detected and digitized to produce a trace a of the actual voltage across inductor 200.

Referring now to FIG. 4, a digital processing system B is disclosed. This system performs the method used with system A of FIG. 1 and with the system shown in FIG. 3. Digitizer 300 converts the analog "VARIABLE" signal in line 230 to a digitized signal in output 340. A signal or enable input on line 302 starts the operation of system B. This enable signal also initiates the operation of the incrementor 310, which TTL device is driven by either the "POSITION" pulses in line 132 or "TIME" pulses in input line 312. Of course, both of these inputs could be employed for incrementing the incrementor 310 in phase with position and real time. Pulses in line 132 could be read to signal when the particular cam surface is shifted into inductor 200. At that time the camshaft is stopped in an axial direction and pulses in line 312 increments digitizer 300 by logic in output line 320. Each value is transferred with a TIME pulse. The time period is 0.10 seconds in the preferred embodiment of the present invention. Incrementing pulses in output 320 causes outputting of digitized information or value in line 340. This data is combined with incrementing logic of pulses in output 320 in a manner that display 400 creates a trace of the digitized voltage representative analog signal. This trace is indicative of the electromagnetic characteristics of the workpiece which, in this illustration, is one of the axially spaced cams or cam surfaces 112, 114, 116. Display 400 exhibits trace m as is interrogated or read at the appropriately designated locations corresponding with the cam surfaces to produce information or data regarding the induction heating process, at each of the axially spaced cams. FIG. 6 illustrates a magnification of the trace m as shown in FIG. 5 at the spaced cam surfaces, which surfaces are designated as numbers 1 through 5, with the vertical axis of the graph being substantially expanded to magnify the limits between tolerance traces n and o. As can be seen, the heating cycle in this particular instance is a series of heating sub-cycles, each of which is monitored in accordance with the invention as described in connection with FIG. 1. The "POSITION" signals detect the cam locations in the graph while the trace m at the READ areas is sampled by the TIME pulses in line 320. During each of the heating cycles, camshaft 110 is held axially stationary even though the camshaft may be rotated during the heating sub-cycle. When trace m is outside tolerances n, o, as illustrated at cam surface No. 5 in FIG. 6, the total heating cycle is outside optimum conditions and a reject signal is created. This method procedure is illustrated as a digital comparator 412 which reads the limits from a memory 410 and produces a reject signal in mechanism 420 as illustrated in FIG. 4. When inductively heating camshafts, the heating cycle for each cam surface is generally less than about 0.5 seconds. For that reason, the length of the segments in FIG. 6 are relatively short with respect to time. About five readings can be taken. If more resolution is desired the sampling pulse rate can be increased. The upper and lower tolerances n, o are illustrated in FIG. 6 as straight lines. Obviously, these tolerances are normally contoured to match the desired heating pattern during induction heating of the individual cam surfaces Nos. 1 through 5.

Figure 7:
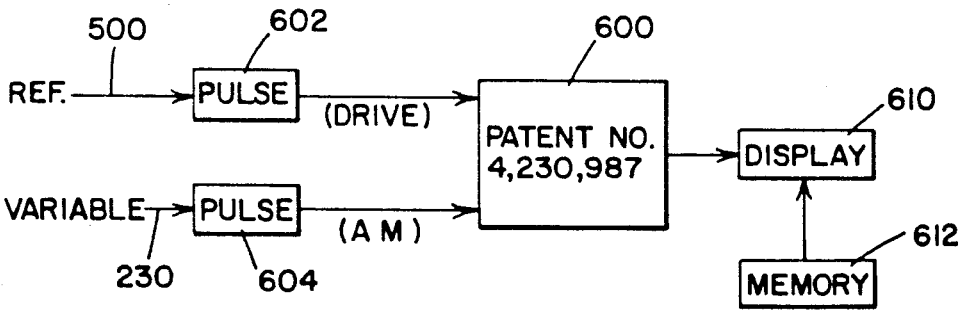
FIG. 7 is a block diagram illustrating one arrangement for employing an eddy current processor in practicing the present invention; and, FIG. 8 is a block diagram of an arrangement for performing the method of the present invention with another eddy current processing device.
Figure 8:
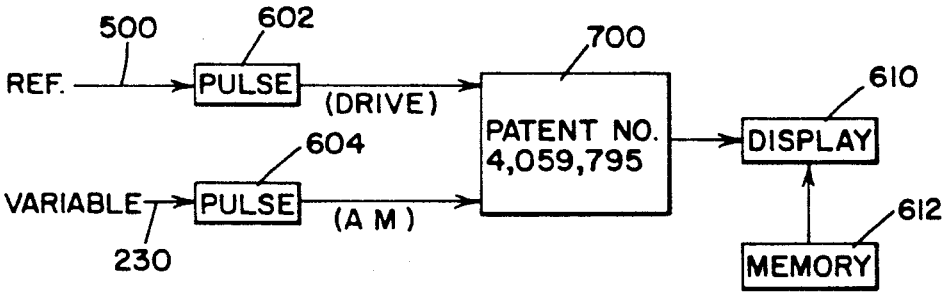

As mentioned in this disclosure, the VARIABLE output indicative of the voltage across inductors 22, 200 varies in a fashion or analog manner similar to the sensed output of an eddy current detector coil; therefore, the VARIABLE output, i.e. line 320, can be processed by standard eddy current processing devices, such as illustrated in Mordwinkin U.S. Pat. Nos. 4,230,987 and 4,059,795. If a more distinct analog signal is required the signal can be taken at the output of rectifier 220. This signal compatability of the VARIABLE signal created in accordance with the present invention with the sensed signal in an eddy current device is illustrated schematically in FIGS. 7 and 8. In accordance with these illustrations, a somewhat stable alternating reference signal is created in line 500. This signal can be obtained by a current transformer 502, shown in FIG. 3. Since the current is somewhat stable in this type of power source, the output wave shape in line 500 is a somewhat stable alternating analog signal having a fixed phase and a generally fixed magnitude. This fixed alternating current can be formed into a desired series of reference pulses by a pulse shaping circuit 602. In this manner, the "DRIVE" signal for eddy current processor 600 is constructed and used as the reference for the equipment disclosed in Mordwinkin U.S. Pat. No. 4,230,987. The VARIABLE voltage signal in line 230 is formed into a series of pulses by pulse shaping circuit 604. In this manner, the VARIABLE signal produces the "AM" input to processor 600. The trace can be created by the eddy current processor and shown on display 610. The trace can be compared to limits stored in memory 612 for the purpose of monitoring the actual heating cycle of inductor 200 as it heats one of the cams on camshaft 110, shown in FIG. 3. FIG. 8 is the same circuit layout shown in FIG. 7 except the eddy current processing circuit 700 is the processing circuit of Mordwinkin U.S. Pat. No. 4,059,795. By employing the present invention, two separate pulsing inputs as needed for the eddy current processors in Mordwinkin U.S. Pat. No. 4,230,987 and Mordwinkin U.S. Pat. No. 4,059,795 can be obtained by practicing the method of the present invention. In practicing the present invention by using an eddy current processor, there is usually no need for the reference signal; therefore, only the VARIABLE signal is employed. In the preferred embodiment of the present invention as illustrated in FIG. 1, eddy current processors are not used; therefore, there is no need for creating a signal representative of the eddy current "DRIVE" signal in eddy current processors.

The present invention could be practiced by using current through the inductor when the power source holds the voltage constant. In this instance, the voltage signal could be used as the reference when using an eddy current processor. The reference signal or pulse train for an eddy current processor could come from a separate area of the power supply without seeking actual load signals.

Having thus defined the invention, the following is claimed:

1. A method of evaluating the electromagnetic characteristics of a ferro-magnetic workpiece being processed in an induction heating system wherein an inductor surrounds said workpiece and an alternating current is applied through said inductor from a power supply during a heating cycle, said method comprising the steps of:

(a) generating an analog signal representative of the voltage across said inductor, as said voltage varies throughout said heating cycle as influenced by changes in the electromagnetic characteristics of said workpiece as said workpiece is being heated throughout said heating cycle;

(b) providing a digitized signal representative of changes in said analog voltage signal, said changes being caused by changes in said workpiece during heating of said workpiece;

(c) creating a trace of said digitized representative signal, said trace being indicative of the pattern of the electromagnetic characteristics of said workpiece as sensed by said inductor throughout said heating cycle; and, (d) evaluating said electromagnetic characteristics by comparing said created trace with a preselected control pattern.

2. A method as defined in claim 1 further including the step of:

(e) moving said workpiece through said inductor during said heating cycle.

3. A method as defined in claim 2 wherein said analog signal is digitized in synchronism with said movement of said workpiece.

* * * * *